US011538621B2

(12) United States Patent
Hirukawa et al.

(10) Patent No.: US 11,538,621 B2
(45) Date of Patent: Dec. 27, 2022

(54) MULTILAYER COIL COMPONENT

(71) Applicant: Murata Manufacturing Co., Ltd., Kyoto-fu (JP)

(72) Inventors: Atsuo Hirukawa, Nagaokakyo (JP); Yuki Nishikawa, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 322 days.

(21) Appl. No.: 16/881,910

(22) Filed: May 22, 2020

(65) Prior Publication Data

US 2020/0373071 A1 Nov. 26, 2020

(30) Foreign Application Priority Data

May 24, 2019 (JP) ..... JP2019-097642

(51) Int. Cl.
*H01F 27/28* (2006.01)
*H01F 27/29* (2006.01)

(52) U.S. Cl.
CPC ..... *H01F 27/2804* (2013.01); *H01F 27/292* (2013.01); *H01F 2027/2809* (2013.01)

(58) Field of Classification Search
CPC ..... H01F 27/292; H01F 27/2804; H01F 2027/2809; H01F 17/0013
See application file for complete search history.

(56) References Cited

U.S. PATENT DOCUMENTS

2014/0145816 A1* 5/2014 Sato ..... H01F 17/0013 336/208
2015/0084729 A1* 3/2015 Lee ..... H01F 17/0013 336/192
2017/0345552 A1* 11/2017 Nakano ..... H01F 27/292

FOREIGN PATENT DOCUMENTS

CN 212461291 U 2/2021
JP 11-307344 A 11/1999
JP 11307344 A * 11/1999
JP 2000-138120 A 5/2000
JP 2014-139981 A 7/2014
JP 2014-207280 A 10/2014
(Continued)

OTHER PUBLICATIONS

An Office Action; "Notice of Reasons for Refusal," mailed by the Japanese Patent Office dated Dec. 21, 2021, which corresponds to Japanese Patent Application No. 2019-097642 and is related to U.S. Appl. No. 16/881,910 with English translation.

*Primary Examiner* — Timothy J Thompson
*Assistant Examiner* — Rhadames Alonzo Miller
(74) *Attorney, Agent, or Firm* — Studebaker & Brackett PC

(57) ABSTRACT

A multilayer coil component includes a multilayer body formed by stacking a plurality of insulating layers in a length direction and that has a built-in coil, and first and second outer electrodes that are electrically connected to the coil. The coil is formed by a plurality of coil conductors stacked in the length direction being electrically connected to each other. The first and second outer electrodes respectively cover parts of first and second end surfaces and parts of a first main surface. The length of a region in which the coil conductors are arranged in the stacking direction lies in a range from 85% to 95% of the length of the multilayer body. The sum of the numbers of stacked coil conductors that face the parts of the first and second outer electrodes extending along the first main surface is less than or equal to twelve.

11 Claims, 6 Drawing Sheets

(56) References Cited

FOREIGN PATENT DOCUMENTS

| | | | |
|---|---|---|---|
| JP | 2017212372 | A | 11/2017 |
| JP | 2018-098368 | A | 6/2018 |

* cited by examiner

MULTILAYER COIL COMPONENT

CROSS-REFERENCE TO RELATED APPLICATION

This application claims benefit of priority to Japanese Patent Application No. 2019-097642, filed May 24, 2019, the entire content of which is incorporated herein by reference.

BACKGROUND

Technical Field

The present disclosure relates to a multilayer coil component.

Background Art

As an example of a coil component, Japanese Unexamined Patent Application Publication No. 2017-212372 discloses a coil component in which the stacking direction and the coil axis are both parallel to the mounting surface of the coil component.

In the coil component disclosed in Japanese Unexamined Patent Application Publication No. 2017-212372, an element body that includes a coil-shaped conductor part includes a first part, a second part, and a third part that are sequentially arranged in a direction parallel to a center axis of the coil. The glass content of the second part is higher than that of the first part and the third part, and the coil component has good characteristics in a high-frequency band located at around 10 GHz. However, in response to the increasing communication speed and miniaturization of electronic devices in recent years, it is demanded that multilayer inductors have satisfactory radio-frequency characteristics in higher frequency bands (for example, a GHz band located at frequencies greater than or equal to 60 GHz). There is a problem with the coil component disclosed in Japanese Unexamined Patent Application Publication No. 2017-212372 in that the radio-frequency characteristics of the coil component are not satisfactory in a band located at frequencies greater than or equal to 60 GHz.

SUMMARY

Accordingly, the present disclosure provides a multilayer coil component that has excellent radio-frequency characteristics.

A multilayer coil component according to a preferred embodiment of the present disclosure includes a multilayer body that is formed by stacking a plurality of insulating layers on top of one another in a length direction and that has a coil built into the inside thereof; and a first outer electrode and a second outer electrode that are electrically connected to the coil. The coil is formed by a plurality of coil conductors stacked in the length direction together with the insulating layers being electrically connected to each other. The multilayer body has a first end surface and a second end surface, which face each other in the length direction, a first main surface and a second main surface, which face each other in a height direction perpendicular to the length direction, and a first side surface and a second side surface, which face each other in a width direction perpendicular to the length direction and the height direction. The first outer electrode extends along and covers part of the first end surface and part of the first main surface. The second outer electrode extends along and covers part of the second end surface and part of the first main surface. The first main surface is a mounting surface. A stacking direction of the multilayer body and a coil axis direction of the coil are parallel to the first main surface. A length of a region in which the coil conductors are arranged in the stacking direction lies in a range from 85% to 95% of a length of the multilayer body. A sum of the number of stacked coil conductors that face a part of the first outer electrode that extends along the first main surface and the number of stacked coil conductors that face a part of the second outer electrode that extends along the first main surface is less than or equal to twelve.

According to the preferred embodiment of the present disclosure, a multilayer coil component that has excellent radio-frequency characteristics can be provided.

Other features, elements, characteristics and advantages of the present disclosure will become more apparent from the following detailed description of preferred embodiments of the present disclosure with reference to the attached drawings.

DETAILED DESCRIPTION

Hereafter, a multilayer coil component according to an embodiment of the present disclosure will be described. However, the present disclosure is not limited to the following embodiment and the present disclosure can be applied with appropriate modifications within a range that does not alter the gist of the present disclosure. Combinations consisting of two or more desired configurations among the configurations described below are also included in the scope of the present disclosure.

Figure 1:
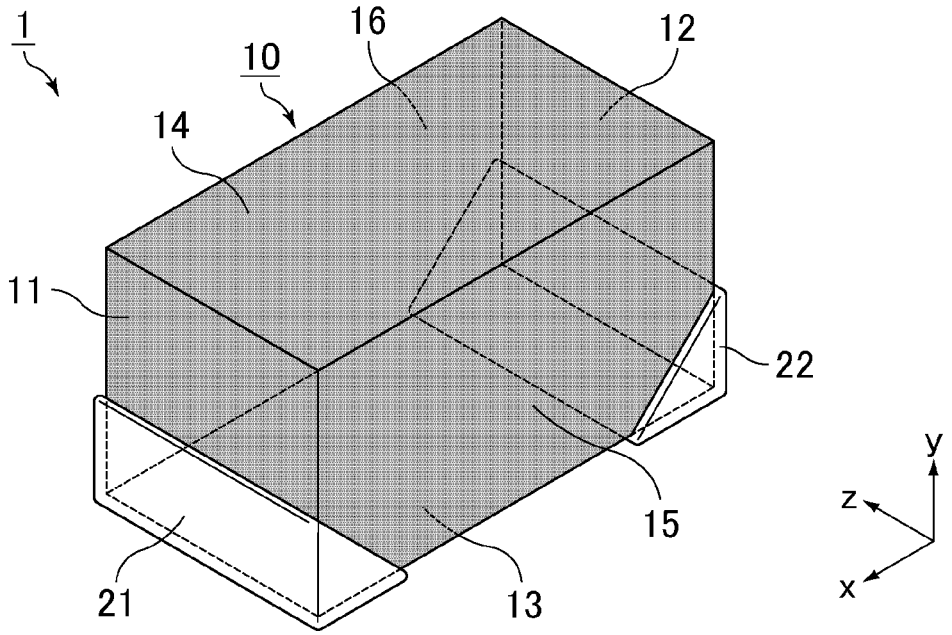
FIG. 1 is a perspective view schematically illustrating an example of a multilayer coil component according to an embodiment of the present disclosure.
Figure 2A:
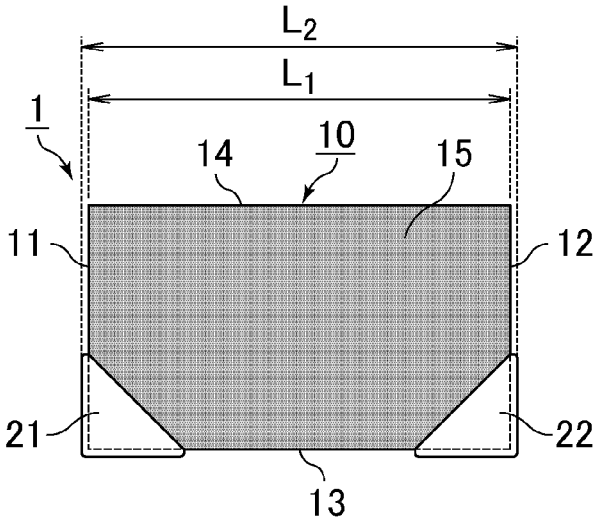
FIG. 2A is a side view of the multilayer coil component illustrated in FIG. 1.
Figure 2B:
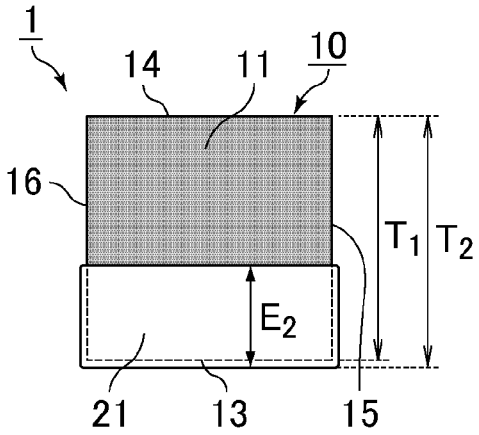
FIG. 2B is a front view of the multilayer coil component illustrated in FIG. 1.
Figure 2C:
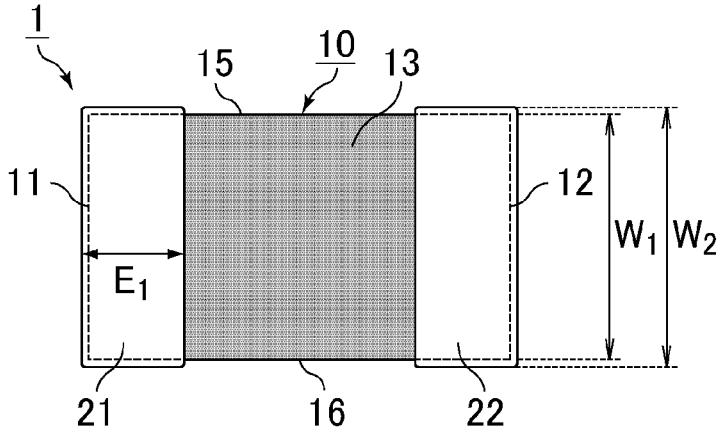
FIG. 2C is a bottom view of the multilayer coil component illustrated in FIG. 1.

FIG. 1 is a perspective view schematically illustrating an example of a multilayer coil component according to an embodiment of the present disclosure. FIG. 2A is a side view of the multilayer coil component illustrated in FIG. 1, FIG. 2B is a front view of the multilayer coil component illustrated in FIG. 1, and FIG. 2C is a bottom view of the multilayer coil component illustrated in FIG. 1.

A multilayer coil component 1 illustrated in FIGS. 1, 2A, 2B, and 2C includes a multilayer body 10, a first outer electrode 21, and a second outer electrode 22. The multilayer body 10 has a substantially rectangular parallelepiped shape having six surfaces. The configuration of the multilayer body 10 will be described later, but the multilayer body 10 is formed by stacking a plurality of insulating layers on top of one another in a length direction and has a coil built into the inside thereof. The first outer electrode 21 and the second outer electrode 22 are electrically connected to the coil.

In the multilayer coil component 1 and the multilayer body 10 of the embodiment of the present disclosure, a length direction, a height direction, and a width direction are respectively an x direction, a y direction, and a z direction in FIG. 1. Here, the length direction (x direction), the height direction (y direction), and the width direction (z direction) are perpendicular to each other.

As illustrated in FIGS. 1, 2A, 2B, and 2C, the multilayer body 10 has a first end surface 11 and a second end surface 12, which face each other in the length direction (x direction), a first main surface 13 and a second main surface 14, which face each other in the height direction (y direction) perpendicular to the length direction, and a first side surface 15 and a second side surface 16, which face each other in the width direction (z direction) perpendicular to the length direction and the height direction.

Although not illustrated in FIG. 1, corner portions and edge portions of the multilayer body 10 are preferably rounded. The term "corner portion" refers to a part of the multilayer body 10 where three surfaces intersect and the term "edge portion" refers to a part of the multilayer body 10 where two surfaces intersect.

The first outer electrode 21 is arranged so as to cover part of the first end surface 11 of the multilayer body 10 as illustrated in FIGS. 1 and 2B and so as to extend from the first end surface 11 and cover part of the first main surface 13 of the multilayer body 10, as illustrated in FIGS. 1 and 2C. As illustrated in FIG. 2B, the first outer electrode 21 covers a region of the first end surface 11 that includes the edge portion that intersects the first main surface 13, and may extend from the first end surface 11 so as to cover the second main surface 14.

In FIG. 2B, the height of the part of the first outer electrode 21 that covers the first end surface 11 of the multilayer body 10 is constant, but the shape of the first outer electrode 21 is not particularly limited so long as the first outer electrode 21 covers part of the first end surface 11 of the multilayer body 10. For example, the first outer electrode 21 may have an arch-like shape that increases in height from the ends thereof toward the center thereof on the first end surface 11 of the multilayer body 10. In addition, in FIG. 2C, the length of the part of the first outer electrode 21 that covers the first main surface 13 of the multilayer body 10 is constant, but the shape of the first outer electrode 21 is not particularly limited so long as the first outer electrode 21 covers part of the first main surface 13 of the multilayer body 10. For example, the first outer electrode 21 may have an arch-like shape that increases in length from the ends thereof toward the center thereof on the first main surface 13 of the multilayer body 10.

As illustrated in FIGS. 1 and 2A, the first outer electrode 21 may be additionally arranged so as to extend from the first end surface 11 and the first main surface 13 and cover part of the first side surface 15 and part of the second side surface 16. In this case, as illustrated in FIG. 2A, the parts of the first outer electrode 21 covering the first side surface 15 and the second side surface 16 are preferably formed in a diagonal shape relative to both the edge portion that intersects the first end surface 11 and the edge portion that intersects the first main surface 13. However, the first outer electrode 21 does not have to be arranged so as to cover part of the first side surface 15 and part of the second side surface 16.

The second outer electrode 22 is arranged so as to cover part of the second end surface 12 of the multilayer body 10 and so as to extend from the second end surface 12 and cover part of the first main surface 13 of the multilayer body 10. Similarly to the first outer electrode 21, the second outer electrode 22 covers a region of the second end surface 12 that includes the edge portion that intersects the first main surface 13. In addition, similarly to the first outer electrode 21, the second outer electrode 22 may extend from the second end surface 12 and cover part of the second main surface 14, part of the first side surface 15, and part of the second side surface 16.

Similarly to the first outer electrode 21, the shape of the second outer electrode 22 is not particularly limited so long as the second outer electrode 22 covers part of the second end surface 12 of the multilayer body 10. For example, the second outer electrode 22 may have an arch-like shape that increases in height from the ends thereof toward the center thereof on the second end surface 12 of the multilayer body 10. Furthermore, the shape of the second outer electrode 22 is not particularly limited so long as the second outer electrode 22 covers part of the first main surface 13 of the multilayer body 10. For example, the second outer electrode 22 may have an arch-like shape that increases in length from the ends thereof toward the center thereof on the first main surface 13 of the multilayer body 10.

Similarly to the first outer electrode 21, the second outer electrode 22 may be additionally arranged so as to extend from the second end surface 12 and the first main surface 13 and cover part of the second main surface 14, part of the first side surface 15, and part of the second side surface 16. In this case, the parts of the second outer electrode 22 covering the first side surface 15 and the second side surface 16 are preferably formed in a diagonal shape relative to both the edge portion that intersects the second end surface 12 and the edge portion that intersects the first main surface 13. However, the second outer electrode 22 does not have to be arranged so as to cover part of the second main surface 14, part of the first side surface 15, and part of the second side surface 16.

The first outer electrode 21 and the second outer electrode 22 are arranged in the manner described above, and therefore the first main surface 13 of the multilayer body 10 serves as a mounting surface when the multilayer coil component 1 is mounted on a substrate.

Although the size of the multilayer coil component 1 according to the embodiment of the present disclosure is not particularly limited, the multilayer coil component 1 is preferably the 0603 size, the 0402 size, or the 1005 size.

In the case where the multilayer coil component 1 according to the embodiment of the present disclosure is the 0603 size, the length of the multilayer body 10 (length indicated by double-headed arrow $L^1$ in FIG. 2A) preferably lies in a range from 0.57 mm to 0.63 mm and more preferably lies in a range from 0.56 mm (560 μm) to 0.60 mm (600 μm). In the case where the multilayer coil component 1 according to the embodiment of the present disclosure is the 0603 size, the width of the multilayer body 10 (length indicated by double-headed arrow $W_1$ in FIG. 2C) preferably lies in a range from 0.27 mm to 0.33 mm. In the case where the multilayer coil component 1 according to the embodiment of the present disclosure is the 0603 size, the height of the multilayer body 10 (length indicated by double-headed arrow $T_1$ in FIG. 2B) preferably lies in a range from 0.27 mm to 0.33 mm.

In the case where the multilayer coil component 1 according to the embodiment of the present disclosure is the 0603 size, the length of the multilayer coil component 1 (length indicated by double arrow $L_2$ in FIG. 2A) preferably lies in a range from 0.57 mm to 0.63 mm. In the case where the multilayer coil component 1 according to the embodiment of the present disclosure is the 0603 size, the width of the multilayer coil component 1 (length indicated by double-headed arrow $W_2$ in FIG. 2C) preferably lies in a range from 0.27 mm to 0.33 mm. In the case where the multilayer coil component 1 according to the embodiment of the present disclosure is the 0603 size, the height of the multilayer coil component 1 (length indicated by double-headed arrow $T_2$ in FIG. 2B) preferably lies in a range from 0.27 mm to 0.33 mm.

In the case where the multilayer coil component 1 according to the embodiment of the present disclosure is the 0603 size, the length of the part of the first outer electrode 21 that covers the first main surface 13 of the multilayer body 10 (length indicated by double-headed arrow $E^1$ in FIG. 2C) preferably lies in a range from 0.12 mm to 0.22 mm. Similarly, the length of the part of the second outer electrode 22 that covers the first main surface 13 of the multilayer body 10 preferably lies in a range from 0.12 mm to 0.22 mm Additionally, in the case where the length of the part of the first outer electrode 21 that covers the first main surface 13 of the multilayer body 10 and the length of the part of the second outer electrode 22 that covers the first main surface 13 of the multilayer body 10 are not constant, it is preferable that the lengths of the longest parts thereof lie within the above-described range.

In the case where the multilayer coil component 1 according to the embodiment of the present disclosure is the 0603 size, the height of the part of the first outer electrode 21 that covers the first end surface 11 of the multilayer body 10 (length indicated by double-headed arrow $E_2$ in FIG. 2B) preferably lies in a range from 0.10 mm to 0.20 mm. Similarly, the height of the part of the second outer electrode 22 that covers the second end surface 12 of the multilayer body 10 preferably lies in a range from 0.10 mm to 0.20 mm. In this case, stray capacitances arising from the outer electrodes 21 and 22 can be reduced. In the case where the height of the part of the first outer electrode 21 that covers the first end surface 11 of the multilayer body 10 and the height of the part of the second outer electrode 22 that covers the second end surface 12 of the multilayer body 10 are not constant, it is preferable that the heights of the highest parts thereof lie within the above-described range.

In the case where the multilayer coil component 1 according to the embodiment of the present disclosure is the 0402 size, the length of the multilayer body 10 preferably lies in a range from 0.38 mm to 0.42 mm and the width of the multilayer body 10 preferably lies in a range from 0.18 mm to 0.22 mm. In the case where the multilayer coil component 1 according to the embodiment of the present disclosure is the 0402 size, the height of the multilayer body 10 preferably lies in a range from 0.18 mm to 0.22 mm.

In the case where the multilayer coil component 1 according to the embodiment of the present disclosure is the 0402 size, the length of the multilayer coil component 1 preferably lies in a range from 0.38 mm to 0.42 mm. In the case where the multilayer coil component 1 according to the embodiment of the present disclosure is the 0402 size, the width of the multilayer coil component 1 preferably lies in a range from 0.18 mm to 0.22 mm. In the case where the multilayer coil component 1 according to the embodiment of the present disclosure is the 0402 size, the height of the multilayer coil component 1 preferably lies in a range from 0.18 mm to 0.22 mm.

In the case where the multilayer coil component 1 according to the embodiment of the present disclosure is the 0402 size, the length of the part of the first outer electrode 21 that covers the first main surface 13 of the multilayer body 10 preferably lies in a range from 0.08 mm to 0.15 mm. Similarly, the length of the part of the second outer electrode 22 that covers the first main surface 13 of the multilayer body 10 preferably lies in a range from 0.08 mm to 0.15 mm.

In the case where the multilayer coil component 1 according to the embodiment of the present disclosure is the 0402 size, the height of the part of the first outer electrode 21 that covers the first end surface 11 of the multilayer body 10 preferably lies in a range from 0.06 mm to 0.13 mm. Similarly, the height of the part of the second outer electrode 22 that covers the second end surface 12 of the multilayer body 10 preferably lies in a range from 0.06 min to 0.13 mm. In this case, stray capacitances arising from the outer electrodes 21 and 22 can be reduced.

In the case where the multilayer coil component 1 according to the embodiment of the present disclosure is the 1005 size, the length of the multilayer body 10 preferably lies in a range from 0.95 mm to 1.05 mm and the width of the multilayer body 10 preferably lies in a range from 0.45 mm to 0.55 mm. In the case where the multilayer coil component 1 according to the embodiment of the present disclosure is the 1005 size, the height of the multilayer body 10 preferably lies in a range from 0.45 mm to 0.55 mm.

In the case where the multilayer coil component 1 according to the embodiment of the present disclosure is the 1005 size, the length of the multilayer coil component 1 preferably lies in a range from 0.95 mm to 1.05 mm. In the case where the multilayer coil component 1 according to the embodiment of the present disclosure is the 1005 size, the width of the multilayer coil component 1 preferably lies in a range from 0.45 mm to 0.55 mm. In the case where the multilayer coil component 1 according to the embodiment of the present disclosure is the 1005 size, the height of the multilayer coil component 1 preferably lies in a range from 0.45 mm to 0.55 mm.

In the case where the multilayer coil component 1 according to the embodiment of the present disclosure is the 1005 size, the length of the part of the first outer electrode 21 that covers the first main surface 13 of the multilayer body 10 preferably lies in a range from 0.20 mm to 0.38 mm. Similarly, the length of the part of the second outer electrode 22 that covers the first main surface 13 of the multilayer body 10 preferably lies in a range from 0.20 mm to 0.38 mm.

In the case where the multilayer coil component 1 according to the embodiment of the present disclosure is the 1005 size, the height of the part of the first outer electrode 21 that covers the first end surface 11 of the multilayer body 10 preferably lies in a range from 0.15 mm to 0.33 mm. Similarly, the height of the part of the second outer electrode 22 that covers the second end surface 12 of the multilayer body 10 preferably lies in a range from 0.15 mm to 0.33 mm. In this case, stray capacitances arising from the outer electrodes 21 and 22 can be reduced.

The coil that is built into the multilayer body 10 of the multilayer coil component 1 according to the embodiment of the present disclosure will be described next. The coil is formed by electrically connecting a plurality of coil conductors, which are stacked together with insulating layers in the length direction, to one another.

Figure 3:
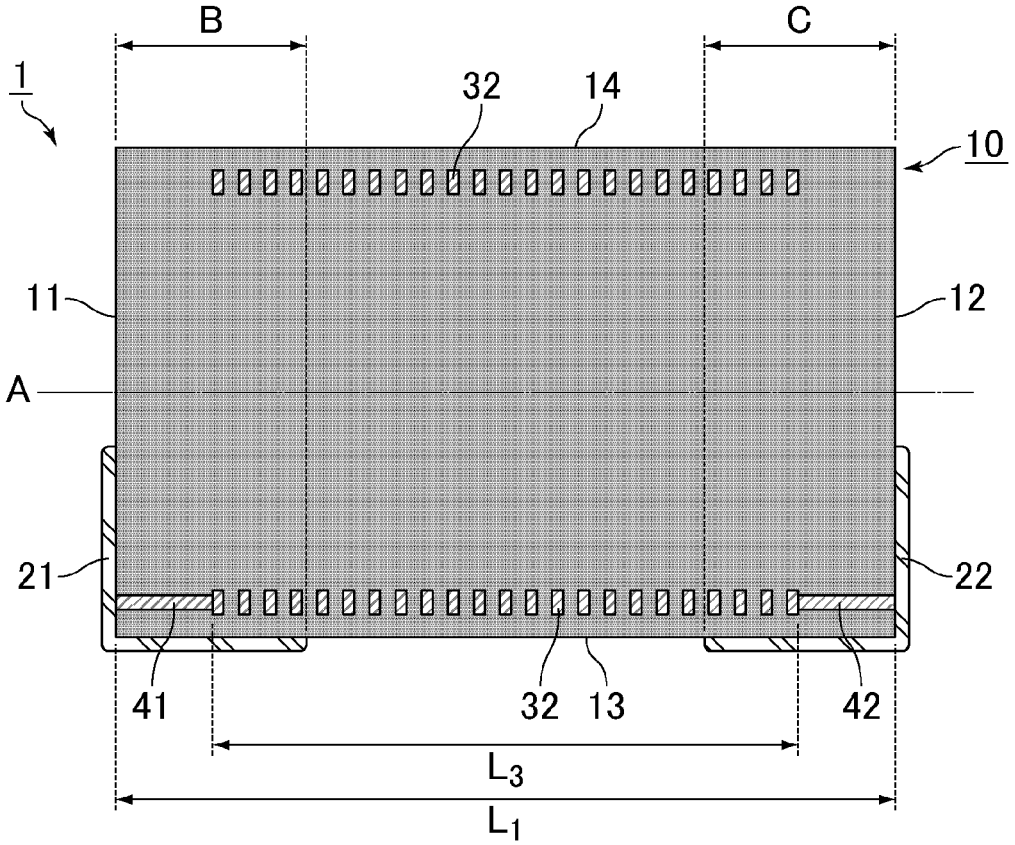
FIG. 3 is a sectional view schematically illustrating an example of the multilayer coil component according to the embodiment of the present disclosure.
Figure 4A:
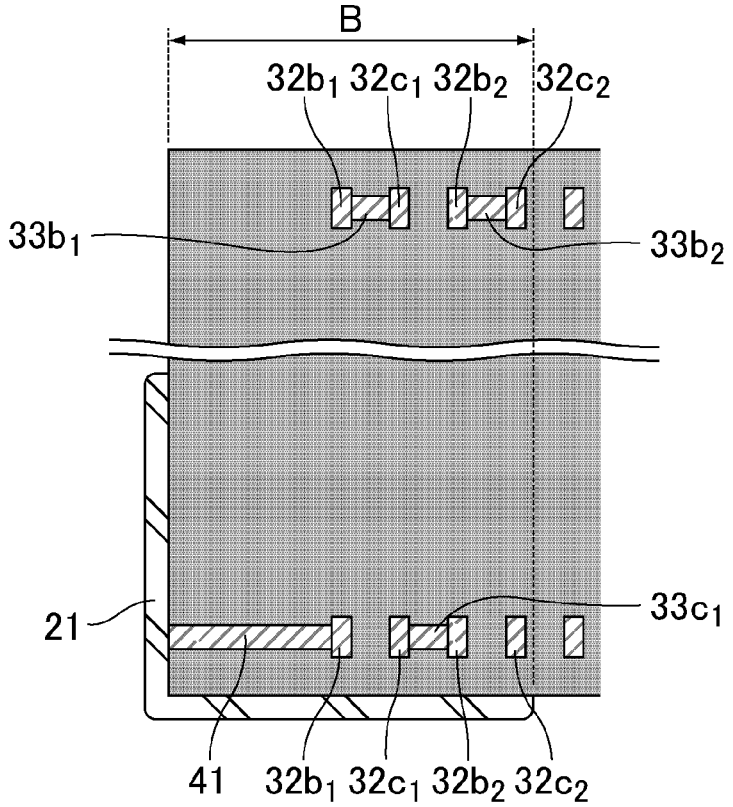
FIG. 4A is an enlarged sectional view taken near a first end surface of the multilayer coil component illustrated in FIG. 3
Figure 4B:
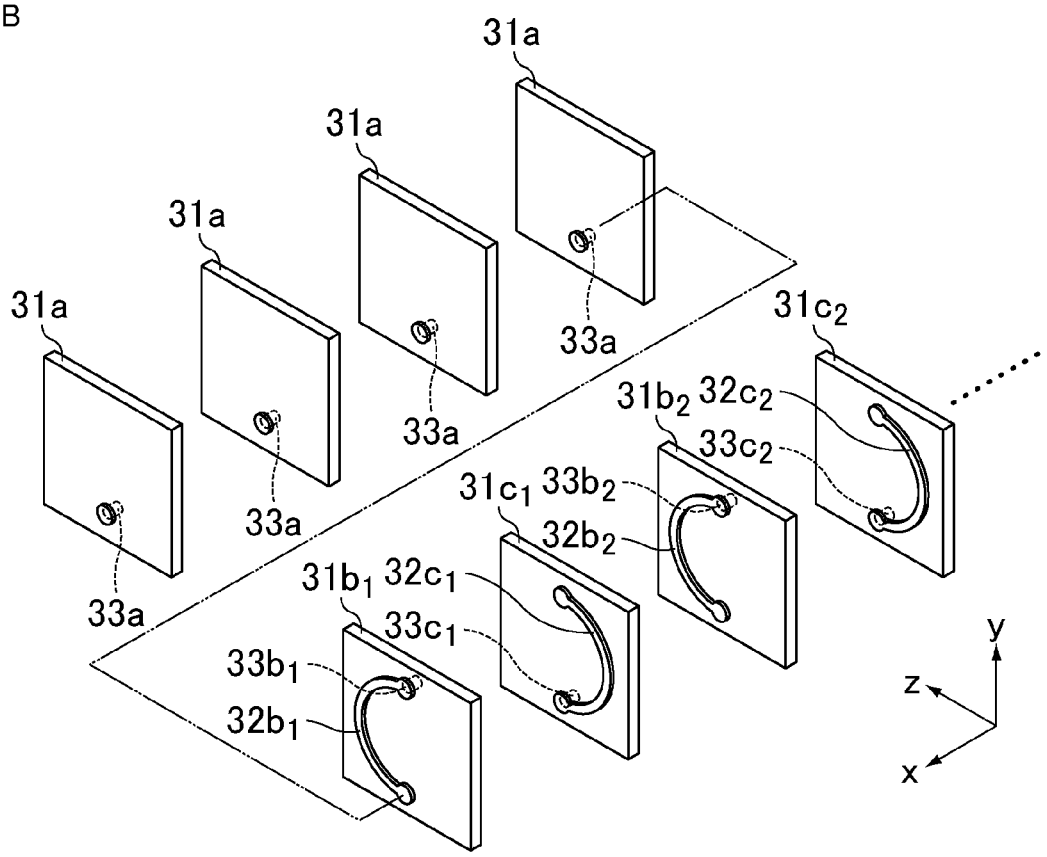
FIG. 4B is an exploded perspective view schematically illustrating insulating layers of a region B in FIG. 4A.

FIG. 3 is a sectional view schematically illustrating an example of the multilayer coil component 1 of the embodiment of the present disclosure, FIG. 4A is an enlarged sectional view taken near the first end surface 11 of the multilayer coil component 1 illustrated in FIG. 3, and FIG. 4B is an exploded perspective view schematically illustrating insulating layers of a region B in FIG. 4A. As illustrated in FIGS. 4A and 4B, the multilayer body 10 is formed by stacking insulating layers 31*a*, 31*b* (31$b_1$ and 31$b_2$), and 31*c* (31$c_1$ and 31$c_2$) in the length direction. Although not illustrated, the insulating layers 31*b* and 31*c* are repeatedly stacked a prescribed number of times (n times) and the insulating layers 31*a* are stacked at both ends of this repeating section. Specifically, the insulating layers 31*b* (31$b_1$ to 31$b_n$) and the insulating layers 31*c* (31$c_1$ to 31$c_n$) are stacked in an alternating manner (31$b_n$ and 31$c_n$ are not illustrated). The direction in which the plurality of insulating layers of the multilayer body 10 are stacked is called the stacking direction. In other words, in the multilayer coil component 1 of the embodiment of the present disclosure, the length direction of the multilayer body 10 and the stacking direction of the insulating layers match each other.

Coil conductors 32*b* (32$b_1$ and 32$b_2$) and 32*c* (32$c_1$ and 32$c_2$) and via conductors 33*b* (33$b_1$ and 33$b_2$) and 33*c* (33$c_1$ and 33$c_2$) are respectively provided on and in the insulating layers 31*b* (31$b_1$ and 31$b_2$) and 31*c* (31$c_1$ and 31$c_2$). The coil conductors 32*b* (32$b_1$ and 32$b_2$) and 32*c* (32$c_1$ and 32$c_2$) each include a line portion and land portions disposed at the ends of the line portion. As illustrated in FIG. 4B, it is preferable the land portions be slightly larger than the line width of the line portions.

The coil conductors 32*b* (32$b_1$ and 32$b_2$) and 32*c* (32$c_1$ and 32$c_2$) are respectively provided on main surfaces of the insulating layers 31*b* (31$b_1$ and 31$b_2$) and 31*c* (31$c_1$ and 31$c_2$) and are stacked together with the insulating layers 31*a*, 31*b* (31$b_1$ and 31$b_2$), and 31*c* (31$c_1$ and 31$c_2$). Therefore, in FIG. 4B, each coil conductor is shaped so as to extend through ½ a turn and the insulating layers 31$b_1$ and 31$c_1$ are repeatedly stacked as one unit (one turn).

The via conductors 33*a*, 33*b* (33$b_1$ and 33$b_2$), and 33*c* (33$c_1$ and 33$c_2$) are provided so as to respectively penetrate through the insulating layers 31*a*, 31*b* (31$b_1$ and 31$b_2$), and 31*c* (31$c_1$ and 31$c_2$) in the stacking direction (x direction in FIG. 4B).

Therefore, a solenoid coil having a coil axis A that extends in the x direction is formed inside the multilayer body 10 by stacking the insulating layers 31*a*, 31*b* (31$b_1$ to 31$b_n$), and 31*c* (31$c_1$ to 31$c_n$) on top of one another in the x direction as illustrated in FIG. 4B.

In addition, as illustrated in FIG. 3, the part of the first outer electrode 21 that extends along the first main surface 13 and the coil conductors 32 face each other in a region (region B) indicated by a double-headed arrow B and the part of the second outer electrode 22 that extends along the first main surface 13 and the coil conductors 32 face each other in a region (region C) indicated by a double-headed arrow C. A coil conductor 32 that faces the first outer electrode 21 is the coil conductor 32$b_1$ as illustrated in FIGS. 4A and 4B. On the other hand, a coil conductor 32 that faces the second outer electrode 22 is the coil conductor 32$c_n$ (not illustrated).

As illustrated in FIGS. 4A and 4B, the number of stacked coil conductors 32 that face the part of the first outer electrode 21 that extends along the first main surface 13 is four. In addition, although not illustrated, the number of stacked coil conductors 32 that face the part of the second outer electrode 22 that extends along the first main surface 13 is also four. Therefore, in the multilayer coil component 1 illustrated in FIG. 3, the sum of the number of stacked coil conductors 32 that face the part of the first outer electrode 21 that extends along the first main surface 13 and the number of stacked coil conductors 32 that face the part of the second outer electrode 22 that extends along the first main surface 13 is eight.

On the other hand, the via conductors 33*a* formed in the insulating layers 31*a* form a first connection conductor 41 and a second connection conductor 42 inside the multilayer body 10 and are exposed at the first end surface 11 and the second end surface 12. One connection conductor is connected in a straight line between the first outer electrode 21 and the coil conductor 32*b* that faces the first outer electrode 21 and the other connection conductor is connected in a straight line between the second outer electrode 22 and the coil conductor 32*b* that faces the second outer electrode 22 inside the multilayer body 10.

It is acceptable for the sum of the number of stacked coil conductors 32 that face the part of the first outer electrode 21 that extends along the first main surface 13 and the number of stacked coil conductors 32 that face the part of the second outer electrode 22 that extends along the first main surface 13 to be less than or equal to twelve, but it is preferable for the sum of these stacked coil conductors 32 to be at least two from the viewpoint of ensuring mountability of the multilayer coil component 1.

As illustrated in FIG. 3, a length $L_3$ of the region in which the coil conductors 32 are arranged in the stacking direction lies in a range from 85% to 95% (90% in FIG. 3) of the length $L_1$ of the multilayer body 10. When the length of the region in which the coil conductors 32 are arranged in the stacking direction lies in a range from 85% to 95% the length of the multilayer body 10, a high inductance can be exhibited.

When the length $L_3$ of the region in which the coil conductors 32 are arranged in the stacking direction lies in a range from 85% to 95% of the length $L_1$ of the multilayer body 10 and the sum of the number of stacked coil conductors 32 that face the part of the first outer electrode 21 that extends along the first main surface 13 and the number of stacked coil conductors 32 that face the part of the second outer electrode 22 that extends along the first main surface 13 is less than or equal to twelve, the transmission coefficient S21 of the multilayer coil component 1 at 60 GHz can be made to be greater than or equal to −3 dB. When the transmission coefficient S21 of the multilayer coil component 1 at 60 GHz is greater than or equal to −3 dB, the multilayer coil component 1 can be suitably used in a bias-tee circuit inside an optical communication circuit, for example. The transmission coefficient S21 is obtained from the ratio of the power of a transmitted signal to the power of an input signal. The transmission coefficient S21 at each frequency can be obtained using a network analyzer, for example. The transmission coefficient S21 is basically a dimensionless quantity, but is usually expressed in dB using the common logarithm.

The coil conductors forming the coil preferably overlap in a plan view from the stacking direction. In addition, the coil preferably has a substantially circular shape in a plan view from the stacking direction. In the case where the coil includes land portions, the shape of the coil is taken to be the shape obtained by removing the land portions (i.e., the shape of the line portions). In addition, in the case where land portions are connected to the via conductors forming the connection conductors, the shape of the connection conductors is the shape obtained by removing the land portions (i.e., the shape of the via conductors).

The phrase "the first connection conductor 41 is connected in a straight line between the first outer electrode 21 and the coil" means that the via conductors 33*a* forming the first connection conductor 41 overlap one another in a plan view from the stacking direction and it is not necessary for the via conductors 33*a* to be perfectly arranged in a straight line. In addition, the phrase "the second connection conductor 42 is connected in a straight line between the second outer electrode 22 and the coil" means that the via conductors 33*a* forming the second connection conductor 42 overlap one another in a plan view from the stacking direction and it is not necessary for the via conductors 33*a* to be perfectly arranged in a straight line. In the case where land portions are connected to the via conductors forming the connection conductors, the shape of the connection conductors is the shape obtained by removing the land portions (i.e., the shape of the via conductors).

The coil conductors illustrated in FIG. 4B are shaped so that the repeating pattern has a substantially circular shape, but the coil conductors may instead be shaped so that the repeating pattern has a substantially polygonal shape such as a substantially quadrangular shape.

In FIG. 4B, two coil conductors are connected to each other in the stacking direction and the resulting repeating unit of the coil is equivalent to one turn of the coil, but the shape of the coil conductors is not limited to this shape. For example, coil conductors, where the coil conductors have a shape equivalent to ¾ of a repeating unit, may be connected to each other in the stacking direction. In this case, repeating units equivalent to three turns of the coil would be formed by stacking four coil conductors.

In a plan view from the stacking direction, the line width of the line portions of the coil conductors preferably lies in a range from 30 μm to 80 μm and more preferably lies in the range from 30 μm to 60 μm. In the case where the line width of the line portions is smaller than 30 μm, the direct-current resistance of the coil may be large. In the case where the line width of the line portions is larger than 80 μm, the electrostatic capacitance of the coil may be large, and therefore the radio-frequency characteristics of the multilayer coil component 1 may be degraded.

The multilayer coil component 1 of the embodiment of the present disclosure is preferably configured so that the land portions are not positioned inside the inner periphery of the line portions and partially overlap the line portions in a plan view from the stacking direction. If the land portions are positioned inside the inner periphery of the line portions, the impedance may undesirably decrease. In addition, the diameter of the land portions is preferably 1.05 to 1.3 times the line width of the line portions in a plan view from the stacking direction. If the diameter of the land portions is less than 1.05 times the line width of the line portions, the connections between the land portions and the via conductors may be unsatisfactory. On the other hand, if the diameter of the land portions is greater than 1.3 times the line width of the line portions, the radio-frequency characteristics may be degraded due to the stray capacitances arising from the land portions becoming larger.

The shape of the land portions in a plan view from the stacking direction may be a substantially circular shape or may be a substantially polygonal shape. In the case where the shape of the land portions is a substantially polygonal shape, the diameter of the land portions is taken to be the diameter of an area-equivalent circle of the polygonal shape.

Figure 5:
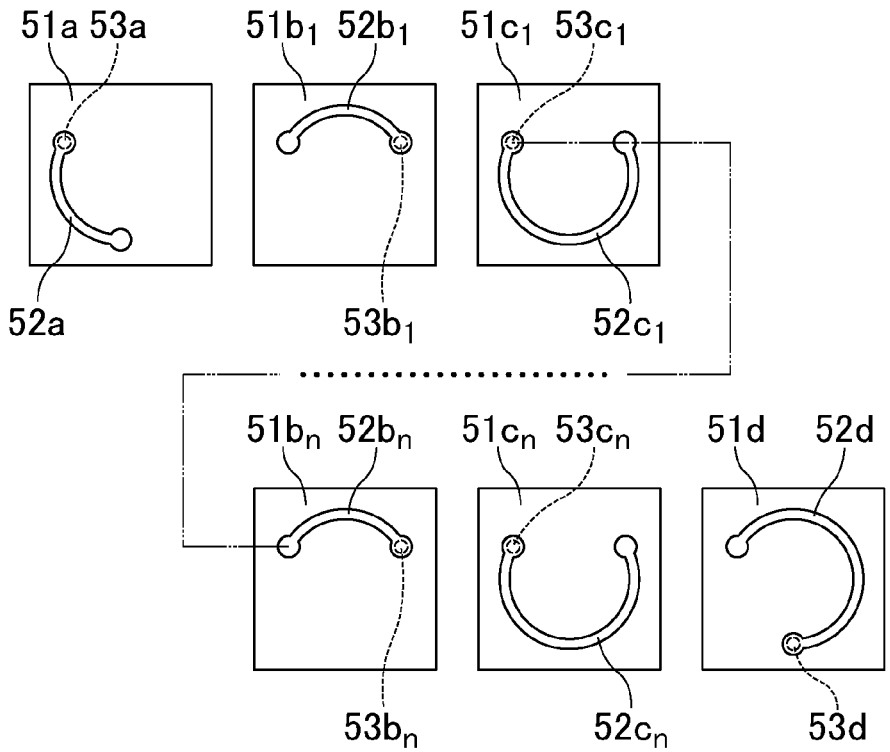
FIG. 5 is a plan view schematically illustrating another example of the shape of coil conductors of the multilayer body.

FIG. 5 is a plan view schematically illustrating another example of the shape of the coil conductors of the multilayer body 10. The shape of the coil conductors can be changed by arranging insulating layers 51*a*, 51*b* (51$b_1$ to 51$b_n$), 51*c* (51$c_1$ to 51$c_n$) and 51*d* illustrated in FIG. 5 instead of the repeating section consisting of the insulating layers 31*b* and 31*c* illustrated in FIG. 4B.

Coil conductors 52*a*, 52*b* (52$b_1$ to 52$b_n$), 52*c* (52$c_1$ to 52$c_n$), and 52*d* and via conductors 53*a*, 53*b* (53$b_1$ to 53$b_n$), 53*c* (53$c_1$ to 53$c_n$), and 53*d* are respectively provided on and in the insulating layers 51*a*, 51*b* (51$b_1$ to 51$b_n$), 51*c* (51$c_1$ to 510, and 51*d*.

The coil conductors 52*a*, 52*b* (52$b_1$ to 52$b_n$), 52*c* (52$c_1$ to 52$c_n$), and 52*d* are respectively provided on the main surfaces of the insulating layers 51*a*, 51*b* (51$b_1$ to 51$b_n$), 51*c* (51$c_1$ to 51$c_n$), and 51*d*. In FIG. 5, the coil conductor 52*b*1 is shaped so as to extend ⅓ turn and the coil conductor 52*c*1 is shaped so as to extend through ⅔ turn and the insulating layers 51*b*1 and 51*c*1 are repeatedly stacked as one unit (one turn). Specifically, a solenoid coil can be formed by repeatedly stacking the insulating layers 51*b* and 51*c* *n* times and arranged the insulating layers 51*a* and 51*d* at the two ends in the order of the insulating layers 51*a*, 51$b_1$, 51$c_1$, 51$b_n$, 51$c_n$, 51*d*.

In the multilayer body obtained by stacking the insulating layers 51*a*, 51*b* (51$b_1$ to 51$b_n$), 51*c* (51$c_1$ to 51$c_n$), and 51*d* illustrated in FIG. 5, in a plan view from the stacking direction, the land portions are disposed in an upper half of the multilayer body on the opposite side from the first main surface (the region where the via conductor 53*d* is provided in the insulating layer 51*d* is the region consisting of the lower half), and therefore stray capacitances generated between the land portions and the via conductors and the outer electrodes are made smaller and the radio-frequency characteristics can be further improved.

The thickness of the coil conductors is not particularly limited, but preferably lies in a range from 3 μm to 6 μm. If the thickness of the coil conductors is less than 3 μm, the direct-current resistance (Rdc) will become large and the amount of heat generated when power is supplied will become large. On the other hand, in the case where the thickness of the coil conductors is greater than 6 μm, stray capacitances may increase due to the distance between coil conductors that are adjacent to each other in the stacking direction becoming smaller and the radio-frequency characteristics may be degraded. When the thickness of the coil conductors lies in a range from 3 μm to 6 μm, the radio-frequency characteristics can be improved while realizing low resistance.

In the multilayer coil component 1 of the embodiment of the present disclosure, the number of stacked coil conductors forming the multilayer body 10 preferably lies in a range from 40 to 60. If the number of stacked coil conductors is less than 40, the stray capacitances will become larger and the transmission coefficient S21 will decrease. If the number of stacked coil conductors exceeds 60, the direct current resistance (Rdc) will become large. The transmission coefficient S21 at 60 GHz can be improved by making the number of stacked coil conductors lie in a range from 40 to 60.

The distance between coil conductors that are adjacent to each other in the stacking direction in the multilayer coil component 1 according to the embodiment of the present disclosure is not particularly limited but preferably lies in a range from 3 μm to 10 μm. When the distance between coil conductors that are adjacent to each other in the stacking direction is greater than 10 μm, it may be necessary to make the land portions larger in order to connect coil conductors to each other and stray capacitances may increase. On the other hand, when the distance between coil conductors that are adjacent to each other in the stacking direction is less than 3 μm, the stray capacitances generated between the coil conductors may increase and the transmission coefficient S21 may decrease.

In the present specification, the distance between coil conductors that are adjacent to each other in the stacking direction is the shortest distance in the stacking direction between the coil conductors that are connected to each other by via conductors. Therefore, the distance between coil conductors that are adjacent to each other in the stacking direction and the distance between coil conductors that cause stray capacitances to be generated are not necessarily the same.

The first main surface 13 of the multilayer coil component 1 according to the embodiment of the present disclosure serves as a mounting surface.

Specific examples of the preferred dimensions of the coil conductors and connection conductors will be described hereafter for cases where the size of the multilayer coil component 1 is the 0603 size, the 0402 size, and the 1005 size.

1. Multilayer coil component is 0603 size

The inner diameter (coil diameter) of each coil conductor preferably lies in a range from 50 μm to 100 μm in a plan view from the stacking direction.

The length of each connection conductor preferably lies in a range from 15 μm to 45 μm and more preferably lies in a range from 15 μm to 30 μm.

The width of each connection conductor preferably lies in a range from 30 μm to 60 μm.

2. Multilayer coil component 1 is 0402 size

The inner diameter (coil diameter) of each coil conductor preferably lies in a range from 30 μm to 70 μm in a plan view from the stacking direction.

The length of each connection conductor preferably lies in a range from 10 μm to 30 μm and more preferably lies in a range from 10 μm to 25 μm.

The width of each connection conductor preferably lies in a range from 20 μm to 40 μm.

3. Multilayer coil component 1 is 1005 size

The inner diameter (coil diameter) of each coil conductor preferably lies in a range from 80 μm to 170 μm in a plan view from the stacking direction.

The length of each connection conductor preferably lies in a range from 25 μm to 75 μm and more preferably lies in a range from 25 μm to 50 μm.

The width of each connection conductor preferably lies in a range from 40 μm to 100 μm.

Method of Manufacturing Multilayer Coil Component

Hereafter, an example of a method of manufacturing a multilayer coil component according to an embodiment of the present disclosure will be described.

First, ceramic green sheets, which will later form the insulating layers, are manufactured. For example, an organic binder such as a polyvinyl butyral resin, an organic solvent such as ethanol or toluene, and a dispersant are added to a ferrite material and the resulting mixture is kneaded to form a slurry. After that, ceramic green sheets having a thickness of around 12 μm are manufactured using a method such as a doctor blade technique.

The ferrite material may be manufactured using the following method, for example. First, iron, nickel, zinc, and copper oxide materials are mixed together and calcined at 800° C. for one hour. After that, manufacture of a Ni—Zn—Cu ferrite material (oxide mixed powder) having an average particle diameter of 2 μm is completed by pulverizing the obtained calcined material with a ball mill and then drying the material.

When manufacturing the ceramic green sheets using a ferrite material, it is preferable that the composition of the ferrite material consist of $Fe_2O_3$ in a range from 40 mol % to 49.5 mol %, ZnO in a range from 5 mol % to 35 mol %, CuO in range from 4 mol % to 12 mol %, and the remainder consisting of NiO and trace amounts of additives (including inevitable impurities) in order to realize a high inductance.

As a ceramic green sheet material, other than a magnetic material such as the ferrite material described above, for example, a non-magnetic material such as a glass ceramic material or a mixed material consisting of a magnetic material and a non-magnetic material may be used.

Next, conductor patterns that will later form the coil conductors and via conductors are formed on and in the ceramic green sheets. For example, first, via holes having a diameter of around 20 μm to 30 μm are formed by subjecting the ceramic green sheets to laser processing. Then, via-conductor conductor patterns are formed by filling the via holes with a conductive paste such as silver paste. In addition, coil-conductor conductor patterns having a thickness of around 11 μm are formed via printing using a method such as screen printing using a conductive paste such as silver paste on main surfaces of the ceramic green sheets. For example, conductor patterns and so on corresponding to the coil conductors illustrated in FIG. 4B are formed as the coil-conductor conductor patterns by performing printing.

Next, drying is performed, and as a result coil sheets having a configuration in which the coil-conductor conductor patterns and the via-conductor conductor patterns are formed on and in ceramic green sheets are obtained. The coil-conductor conductor patterns and the via-conductor conductor patterns are connected to each other in the coil sheets.

Furthermore, via sheets that have a configuration in which via-conductor conductor patterns are formed are manufactured separately from the coil sheets. The via-conductor conductor patterns of the via sheets are conductor patterns that will later form the via conductors constituting the connection conductors.

Next, the coil sheets are stacked in a prescribed order so that a coil having a coil axis that is parallel to the mounting surface will be formed inside the multilayer body after division into individual components and firing. In addition, via sheets are stacked above and below the multilayer body formed of the coil sheets.

The multilayer body consisting of the coil sheets and the via sheets is subjected to thermal pressure bonding in order to obtain a pressure-bonded body, and then the pressure-bonded body is cut into pieces of a predetermined chip size to obtain individual chips. The divided chips may be subjected to barrel polishing in order to round the corner portions and edge portions thereof.

Next, the divided chips are subjected to binder removal and firing at a prescribed temperature and for a prescribed period of time, and multilayer bodies (fired bodies) having a built-in coil are formed. At this time, the coil-conductor conductor patterns and the via-conductor conductor patterns become the coil conductors and the via conductors after firing. The coil is formed by the coil conductors being connected to one another by the via conductors. In addition, the stacking direction of the multilayer body and the coil axis direction of the coil are parallel to the mounting surface.

Next, a conductive paste such as silver paste is spread so as to form a layer of a predetermined thickness and then each multilayer body is dipped at an angle into this layer and baked to form a base electrode layer of an outer electrode on four surfaces (a main surface, an end surface, and both side surfaces) of the multilayer body. Using this method, the base electrode can be formed in one go in contrast to the case where the base electrode is formed separately on the main surface and the end surface of the multilayer body in two steps.

Next, a nickel film and a tin film having predetermined thicknesses are formed on the base electrode layers by performing plating. Thus, the outer electrodes are formed.

A multilayer coil component according to an embodiment of the present disclosure can be manufactured as described above.

EXAMPLES

Hereafter, examples that illustrate the multilayer coil component 1 according to the embodiment of the present disclosure in a more specific manner will be described. The present disclosure is not limited to just the following examples.

Manufacture of Test Pieces

Example 1

1. A ferrite material (calcined powder) having a prescribed composition was prepared.

2. A magnetic slurry was manufactured by adding an organic binder (polyvinyl butyral resin) and organic solvents (ethanol and toluene) to the calcined powder and putting the mixture into a pot mill along with PSZ balls and then sufficiently mixing and pulverizing the mixture in a wet state.

3. The magnetic slurry was molded into a sheet shape using a doctor blade method and then punched into rectangular shapes, thereby producing a plurality of ceramic green sheets having a thickness of 15 μm.

4. An inner-conductor conductive paste containing Ag powder and an organic vehicle was prepared.

5. Via Sheet Manufacture

Via holes were formed by irradiating prescribed locations on the ceramic green sheets with a laser. Via conductors were formed by filling the via holes with a conductive paste and land portions were formed by performing screen printing with a conductive paste in circular shapes around the peripheries of the via conductors.

6. Coil Sheet Manufacture

The coil sheets were obtained by forming via conductors by forming via holes in prescribed locations on the ceramic green sheets and filling the via holes with a conductive paste, and then forming coil conductors including land portions and line portions by performing printing.

7. These sheets were stacked as illustrated in FIG. 4B by stacking the insulating layers 31*b* and 31*c* n times in the order of the insulating layers 31$b_1$, 31$c_1$, 31$b_2$, and 31$c_2$ and then stacking four insulating layers 31*a* at each end of the resulting multilayer body, and after that the multilayer body was heated, pressed, and cut into individual pieces with a dicer to form multilayer molded bodies.

8. (Fired) multilayer bodies were manufactured by placing the multilayer molded bodies in a firing furnace, subjecting the bodies to a binder removal treatment under an air atmosphere at a temperature of 500° C. and then firing the bodies at a temperature of 900° C. The dimensions of thirty of the obtained multilayer bodies were measured using a micrometer, and the following average values were determined: L=0.60 mm, W=0.30 mm, and T=0.30 mm.

9. An outer-electrode conductive paste containing Ag powder and glass frit was poured into a coating film forming tank in order to form a coating film of a predetermined thickness. The places where the outer electrodes are to be formed on each multilayer body were immersed in the coating film.

10. After the immersion, each multilayer body was baked at a temperature of around 800° C. and in this way the base electrodes of the outer electrodes were formed.

11. Formation of the outer electrodes was completed by sequentially forming a Ni film and a Sn film on the base electrodes by performing electroplating. Test pieces of example 1 having the internal structure of the multilayer body 10 illustrated in FIG. 3 were manufactured as described above. In the test pieces of example 1, the length of the part of the first outer electrode 21 formed so as to extend along the first main surface 13 and the length of the part of the second outer electrode 22 formed so as to extend along the first main surface 13 were both 30 μm. In addition, the height of the part of the first outer electrode 21 on the first end surface 11 and the height of the part of the second outer electrode 22 on the second end surface 12 were both 15 μm. The sum of the number of stacked coil conductors that face the part of the first outer electrode 21 that extends along the first main surface 13 and the number of stacked coil conductors that face the part of the second outer electrode 22 that extends along the first main surface 13 was two.

Measurement of Transmission Coefficient S21

Figure 6:
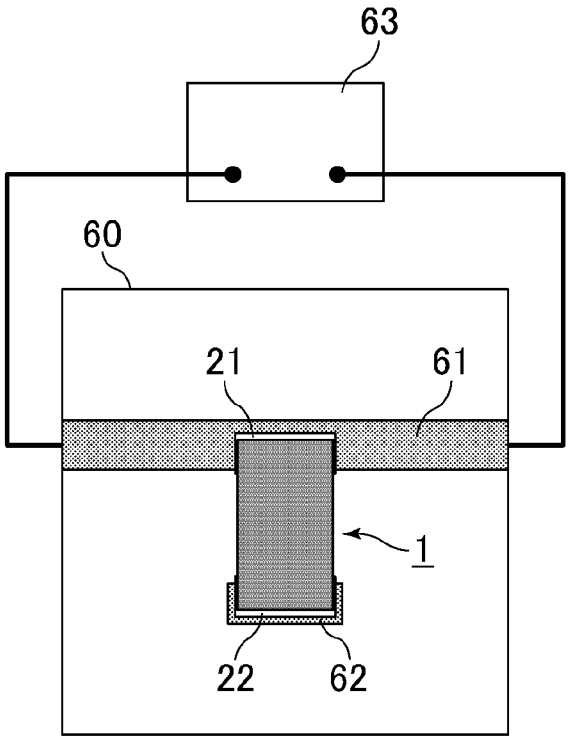
FIG. 6 is a diagram schematically illustrating a method of measuring the transmission coefficient S21.

FIG. 6 is a diagram schematically illustrating a method of measuring the transmission coefficient S21. As illustrated in FIG. 6, a test piece (multilayer coil component 1) was soldered to a measurement jig 60 that was provided with a signal path 61 and a ground conductor 62. The first outer electrode 21 of the multilayer coil component 1 was connected to the signal path 61 and the second outer electrode 22 of the multilayer coil component 1 was connected to the ground conductor 62.

Figure 7:
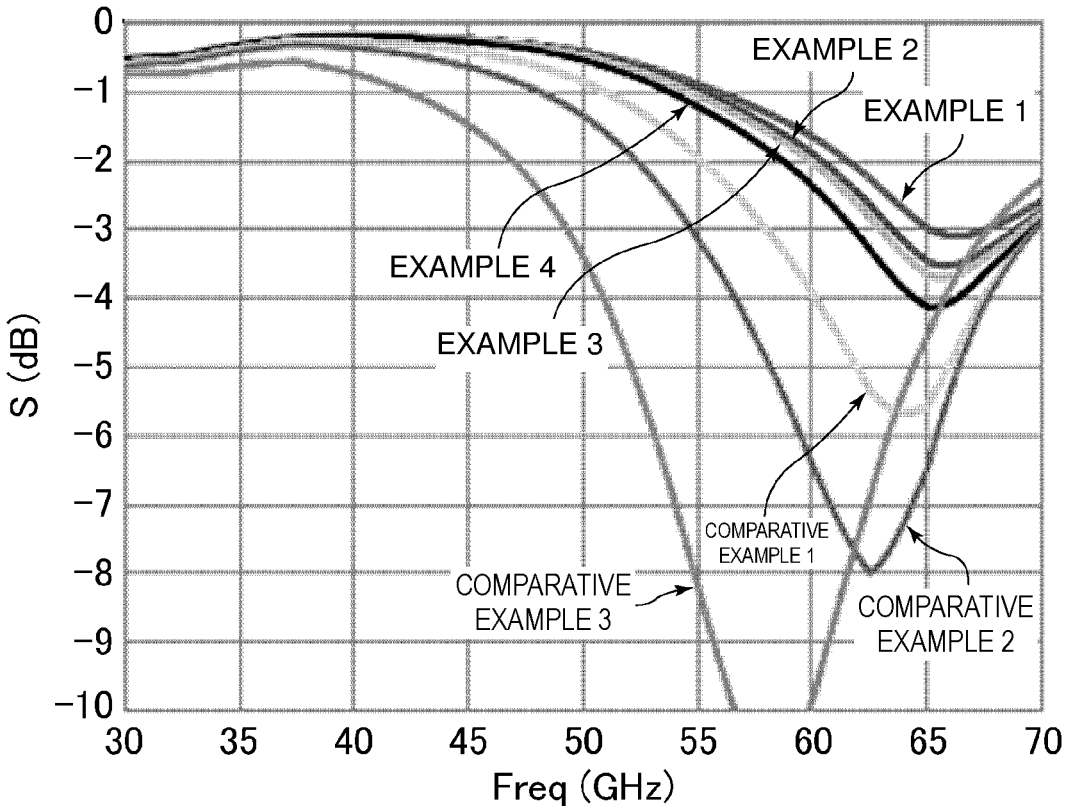
FIG. 7 is a graph illustrating the transmission coefficients S21 of test pieces manufactured in examples.

The transmission coefficient S21 was measured by obtaining the power of an input signal to the test piece and the power of a transmitted signal from the test piece and changing the signal frequency using a network analyzer 63. The two ends of the signal path 61 are connected to the network analyzer 63. The measurement results are illustrated in FIG. 7 and the respective transmission coefficients S21 at 60 GHz are illustrated in Table 1. FIG. 7 is a graph illustrating the transmission coefficients S21 of test pieces manufactured in examples. The transmission coefficient S21 indicates that the closer the transmission coefficient S21 is to 0 dB, the smaller the loss is.

Examples 2 to 4 and Comparative Examples 1 to 3

Multilayer coil components according to examples 2 to 4 and comparative examples 1 to 3 were manufactured using the same procedure as described in example 1 except that the total length of the parts of the outer electrodes that extend along the first main surface were changed by adjusting the angle and depth at which each multilayer body was immersed in the coating film in the step of forming the base electrodes and the number of stacked coil conductors facing the outer electrodes was changed as illustrated in Table 1, and then the transmission coefficients S21 were measured. The results are illustrated in FIG. 7 and Table 1.

TABLE 1

| | Total length of parts of outer electrodes extending along first main surface | Number of stacked coil conductors facing outer electrodes | Transmission coefficient S21 (dB) at 60 GHz |
|---|---|---|---|
| Example 1 | 60 | 2 | −1.64 |
| Example 2 | 80 | 4 | −1.89 |
| Example 3 | 120 | 8 | −2.02 |
| Example 4 | 160 | 12 | −2.49 |
| Comparative Example 1 | 200 | 16 | −3.70 |
| Comparative Example 2 | 240 | 20 | −6.70 |
| Comparative Example 3 | 280 | 24 | −9.81 |

From the results listed in Table 1, it is clear that the multilayer coil component 1 according to the embodiment of the present disclosure has a transmission coefficient S21 that is greater than or equal to −3.0 dB at 60 GHz and has excellent radio-frequency characteristics.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A multilayer coil component comprising:

a multilayer body that is formed by stacking a plurality of insulating layers on top of one another in a length direction and that has a coil built into the inside thereof; and a first outer electrode and a second outer electrode that are electrically connected to the coil;

wherein the coil is formed by a plurality of coil conductors stacked in the length direction together with the insulating layers being electrically connected to each other, the multilayer body has a first end surface and a second end surface, which face each other in the length direction, a first main surface and a second main surface, which face each other in a height direction perpendicular to the length direction, and a first side surface and a second side surface, which face each other in a width direction perpendicular to the length direction and the height direction, the first outer electrode extends along and covers a portion of the first end surface and a portion of the first main surface, the second outer electrode extends along and covers a portion of the second end surface and a portion of the first main surface, the first main surface is a mounting surface, a stacking direction of the multilayer body and a coil axis direction of the coil are parallel to the first main surface, a length of a region in which the coil conductors are arranged in the stacking direction is in a range from 85% to 95% of a length of the multilayer body, and a sum of a number of stacked coil conductors that face a portion of the first outer electrode that extends along the first main surface and a number of stacked coil conductors that face a portion of the second outer electrode that extends along the first main surface is greater than or equal to two and less than or equal to twelve.

2. The multilayer coil component according to claim 1, wherein a number of stacked coil conductors is in a range from 40 to 60.

3. The multilayer coil component according to claim 1, wherein a thickness of the coil conductor is in a range from 3 μm to 6 μm.

4. The multilayer coil component according to claim 1, wherein the length of the multilayer body is in a range from 560 μm to 600 μm.

5. The multilayer coil component according to claim 2, wherein a thickness of the coil conductor is in a range from 3 μm to 6 μm.

6. The multilayer coil component according to claim 2, wherein the length of the multilayer body is in a range from 560 μm to 600 μm.

7. The multilayer coil component according to claim 3, wherein the length of the multilayer body is in a range from 560 μm to 600 μm.

8. The multilayer coil component according to claim 5, wherein the length of the multilayer body is in a range from 560 μm to 600 μm.

9. The multilayer coil component according to claim 1, wherein the sum of the number of stacked coil conductors that face the portion of the first outer electrode that extends along the first main surface and the number of stacked coil conductors that face the portion of the second outer electrode that extends along the first main surface is equal to four.

10. The multilayer coil component according to claim 1, wherein the sum of the number of stacked coil conductors that face the portion of the first outer electrode that extends along the first main surface and the number of stacked coil conductors that face the portion of the second outer electrode that extends along the first main surface is equal to eight.

11. The multilayer coil component according to claim 1, wherein the multilayer coil component is configured to increase the transmission coefficient for operation at or above 60 GHz.

* * * * *